US006402125B1

(12) United States Patent
Burns et al.

(10) Patent No.: US 6,402,125 B1
(45) Date of Patent: Jun. 11, 2002

(54) CARBURETOR VALVE ROTATIONAL SETTING RETAINER ASSEMBLY

(75) Inventors: Michael P. Burns, Millington; Gary U. Gliniecki, Ruth; George M. Pattullo, Caro; James E. VanAllen, Clifford, all of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/798,602

(22) Filed: Mar. 2, 2001

Related U.S. Application Data

(63) Continuation-in-part of application No. 09/538,123, filed on Mar. 29, 2000.

(51) Int. Cl.[7] ..... F02M 3/08

(52) U.S. Cl. ..... 261/71; 261/DIG. 38; 261/DIG. 84

(58) Field of Search ..... 261/71, DIG. 38, 261/DIG. 84, DIG. 39

(56) References Cited

U.S. PATENT DOCUMENTS

| | | | | |
|---|---|---|---|---|
| 4,336,208 A | * | 6/1982 | Gerhardy | 261/DIG. 38 |
| 4,568,499 A | * | 2/1986 | Wood | 261/71 X |
| 5,525,267 A | * | 6/1996 | Araki | 261/DIG. 84 |
| 5,695,693 A | * | 12/1997 | Koizumi et al. | 261/71 |
| 5,961,896 A | * | 10/1999 | Koizumi et al. | 261/71 X |
| 5,984,281 A | * | 11/1999 | Hacker et al. | 261/71 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A fuel needle valve assembly of a carburetor has a retainer which yieldingly restrains the rotational fuel flow setting capability of the needle valve. The retainer engages a shank of the needle valve and a parallel shaft, both of which project from the carburetor body. The retainer exerts a force which laterally displaces the projecting shank with respect to the shaft. The retainer has sufficient strength to ensure the factory set rotational setting of the fuel needle valve does not alter when a limiter cap is press fitted to a distal head of the needle. Furthermore, wherein the shaft is also a shank of a second needle valve, the same retainer laterally displaces the projecting shanks of both needle valves.

17 Claims, 4 Drawing Sheets

CARBURETOR VALVE ROTATIONAL SETTING RETAINER ASSEMBLY

REFERENCE TO COPENDING APPLICATION

This application is a continuation-in-part of copending application Ser. No. 09/538,123 filed Mar. 29, 2000.

FIELD OF THE INVENTION

This invention relates to a carburetor valve rotational setting retainer assembly, and more particularly to a rotational setting retainer assembly for low and high-speed needle valves of a carburetor for a combustion engine.

BACKGROUND OF THE INVENTION

Government agencies of an increasing number of countries are imposing exhaust emission control regulations to protect the environment. These regulations are being applied to all combustion engines including portable or two cycle engines used in common equipment such as chain saws, lawn mowers and hedge trimmers. One means of limiting excessive exhaust emissions in a small engine is to restrict the maximum amount of fuel delivered to the combustion chamber. This maximum fuel amount is preset on each individual engine by the engine manufacturer with the understanding that the end user requires some adjustment capability to meet changing work conditions and environmental factors such as altitude. The higher the altitude, the lower the air density, and the lower the fuel amount necessary to operate the engine. The user of the engine must therefore be able to adjust the fuel to air mixture ratios and may do so via low and high-speed needle valves protruding from the carburetor.

Not only is it desirable to limit the richness of the fuel to air mixture because of exhaust emission regulatory concerns, but the engine manufacturer of a portable combustion engine product also wants to restrict minimum amounts of fuel, or the leanness of the fuel to air mixture. Often a user will desire more power from a small engine and will attempt to operate the engine in an ultra-lean state. This will deprive an engine of proper cooling and will lead to warranty concerns. Therefore, limiter caps are designed not only to restrict the carburetor to a maximum amount of fuel, but also to restrict the carburetor to a minimum amount of fuel.

Not only is it desirable to limit the maximum and minimum amounts of fuel, but it is also desirable to hold steady the fuel flow in a running engine. Any rotation of the needle of the needle valve, possibly caused by the vibration of a running engine would alter the fuel flow. Therefore, it is desirable to restrain the rotation of the needle of the needle valves thereby preventing any unintended changes to the fuel flow setting. Traditionally, compressed springs are disposed concentrically about the needle and axially between the carburetor body and the head of the needle valve. The spring induced axial force produces increased frictional forces amongst the threads between the carburetor body and the needle, thus resisting needle rotation and alteration of the fuel flow setting.

Unfortunately, engine vibration is not the only source of unintentionally altered fuel flow. Lateral wobble and axial shifting of the needle tip, disposed within an orifice of the carburetor fuel feed channel, can cause fuel flow changes resulting in a rough running engine. Furthermore, the factory prescribed setting of the low and high-speed needle valves can be rotatably and axially altered when the limit caps are applied to the heads of each needle. For further background information on needle tip wobble, see U.S. patent application Ser. No. 09/584,970 filed on Jun. 1, 2000 which is incorporated by reference herein.

SUMMARY OF THE INVENTION

A retaining assembly maintains the factory pre-set fuel flow settings during the later attachment of a limiter cap to a fuel needle valve of a carburetor. A retainer disposed outward from the carburetor body laterally biases the fuel needle valve which increases frictional forces between the adjustment threads of the needle and carburetor body. The retainer also provides rotation resistant friction between the valve and the retainer itself. Preferably, the carburetor has a pair of spaced-apart and generally parallel low and high-speed needle valves. However, the carburetor may have a single fuel needle valve and a parallel rod cooperating with the retainer to inhibit rotation of the single valve.

Each valve has a needle which adjustably threads to the carburetor body. A shank of the needle protrudes from the carburetor body and engages concentrically a radially enlarged head at the distal end. Restraining rotation of the needle by exerting an axial force is a spring compressed concentrically between the head of the needle and the carburetor body. Restraining rotation of both needles by exerting a lateral force is a retainer aligned generally axially between the carburetor body and the heads of the needles, and preferably disposed radially outward from the springs of the low and high-speed needle valves.

Preferably, the needles have a needle tip which resides within a fuel flow orifice of the carburetor body. Both axial and lateral movement of the tip relative to the orifice respectively changes fuel flow into the throttling bore or mixture chamber. The retainer produces bending stresses and strains within the needles of both valves which propagate longitudinally down the needle to the tip. The tip is thereby biased laterally toward a side of the orifice.

Objects, features and advantages of this invention include the elimination of needle tip wobble which adversely effects fuel flow, providing a simple and inexpensive means to restrain rotation of the low and high speed needle valves, and facilitating and preserving final fuel flow adjustment of the carburetor.

BRIEF DESCRIPTION OF THE DRAWINGS

These and other objects, features and advantages of this invention will be apparent from the following detailed description of the preferred embodiments and best mode, appended claims and accompany drawings in which;

DETAILED DESCRIPTION OF THE PREFERRED EMBODIMENTS

Figure 1:
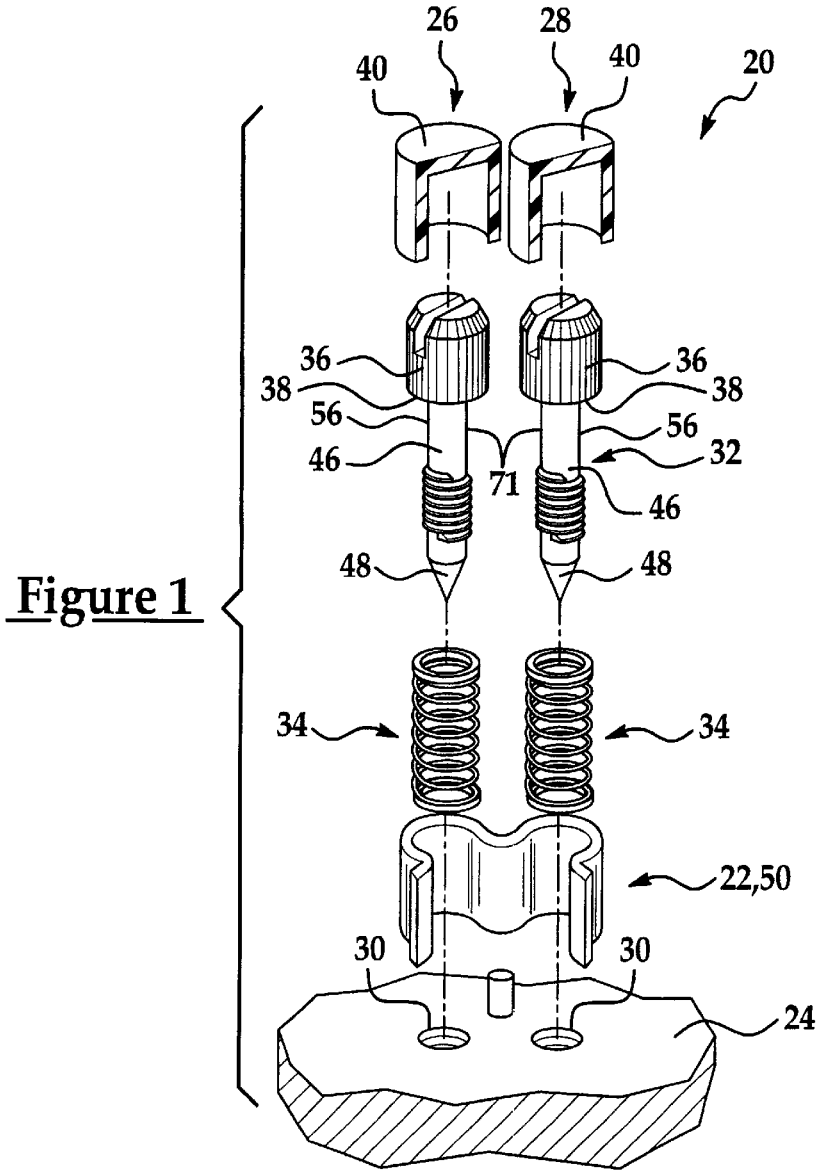
FIG. 1 is an exploded perspective view of a carburetor valve rotational setting retainer assembly having a low and high speed needle valve of this invention.

Referring in more detail to the drawings, FIGS. 1–4 show a low and high speed needle valve assembly 20 having a biasing retainer 22, embodying the present invention. Mounting threadably to a carburetor body 24 are low and high-speed needle valves 26, 28 which move longitudinally, via rotation, in and out of respective threaded ports 30 defined by the carburetor body 24. Air flowing through a throttling bore 31 extending through the carburetor body 24 mixes with a prescribed fuel quantity, or flow rate, controlled by the low and high speed needle valves 26, 28. The fuel flow rate within the carburetor body 24 is adjusted by threadably rotating the needle 32 within the respective port 30 either inward to reduce the fuel flow or outward from the carburetor body 24 to increase the fuel flow.

The low and high-speed needle valves 26, 28 each have a spring 34 and a shank or needle 32. The spring 34 provides resistance against unintentional rotation of the needle 32. The spring 34 concentrically encircles the needle 32 and is compressed axially between a radially extended head 36 of the needle 32 and the carburetor body 24, the spring 34 engaging an inward facing annular surface 38 defined by the radially expanded head 36. The axial constant force produced by the compression of the spring 34 provides the resistance which restrains rotation of the needle 32 by creating friction between the threads of the carburetor body 24 and the needle 32 within the port 30.

Customarily, the low and high-speed needle valves 26, 28 of each carburetor are adjusted and set at the factory by the engine manufacturer after the carburetor body 24 is mounted to a running combustion engine, not shown. If the fuel and air mixture is too lean, the running engine may over heat causing warranty concerns. If the fuel and air mixture is too rich, government regulatory emission requirements may be exceeded or violated. Therefore, limiting adjustment capability by the end user of the engine of the low and high-speed needle valves 26, 28 within an acceptable range is desirable. The engagement of known limiter caps 40 to the valves 26, 28 establishes the end user adjustment range for fuel flow within the carburetor (i.e. neither too rich nor too lean). The limiter caps 40 are press fitted over the heads 36 of the low and high-speed needle valves 26, 28 in the factory after the proper fuel flow settings are made.

Without the retainer assembly and after factory adjustment by the engine manufacturer, the press fitting of the limiter caps 40 to the heads 36 of either one or both of the needles 32 may unintentionally rotate, wobble or laterally shift the needles causing the factory setting and prescribed adjustment range of the needles 32 to be altered or changed. To feasibly solve this problem, the single retainer 22 of the present invention engages and laterally biases a shank 46 of each needle 32 which protrudes outward from the carburetor body 24. Preferably, the retainer 22 is axially aligned and disposed radially outward from the respective springs 34. The lateral force exerted by the retainer 22 against the springs 34 causes the springs 34 to exert a lateral force against the shanks 46 of the needles 32. The needles 32, therefore, are skewed against, or tend to favor one side, of the respective ports 30. The resultant friction between the springs 34 and the shanks 46 along with the increased friction between the threads of the needles 32 and ports 30 will assist the springs 34 to further resist any rotation of the needles 32. That is, the axial force produced by the springs 34 is compounded by the lateral force produced the retainer 22. Furthermore, the necessity of utilizing the spring 34 to resist rotation can be eliminated with a sufficiently strong or appropriately sized retainer 22. In such an embodiment, the force produced by the retainer 22 is exerted directly on the shanks 46 of the low and high speed needle valves 26, 28.

Another feature of the retainer 22 is the elimination or reduction of needle tip 48 wobble within an orifice of the fuel flow channel of the carburetor body 24, not shown. The wobble action of the tip 48 of the needle 32 is caused by machining tolerance limitations of the carburetor body 24 threads contained within port 30 and the mating threads of needle 32. The resultant wobble can affect fuel flow causing a rough running combustion engine. The exertion of a lateral bias or force upon the shanks 46 of the needles 32 by the retainer 22 will produce a longitudinal stress and strain along the needle 32. This causes the needle 32 to favor or even bear on one side of the orifice and thereby eliminates some or all of the adverse wobble effects.

Figure 2:
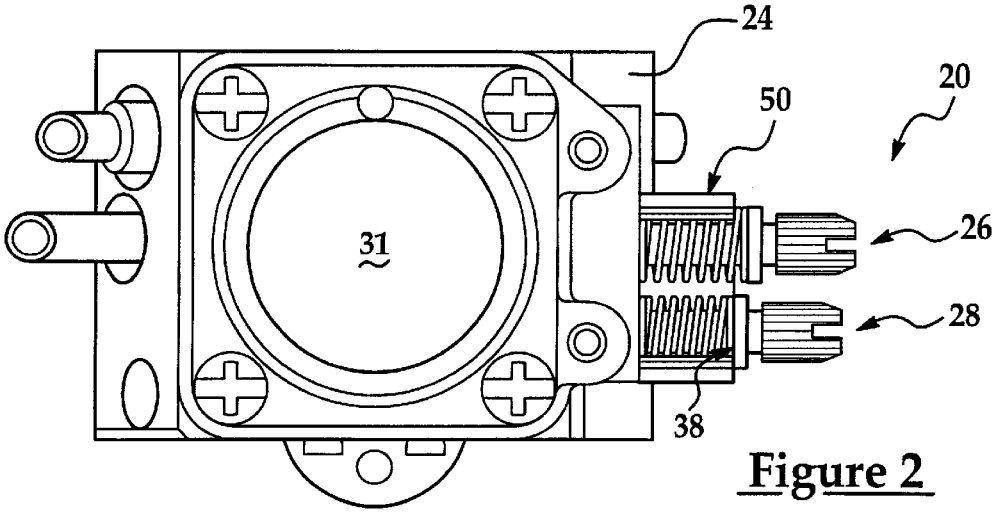
FIG. 2 is a bottom view of a carburetor illustrating the retainer assembly laterally biasing a low-speed needle and a high-speed needle valve toward each other.
Figure 3:
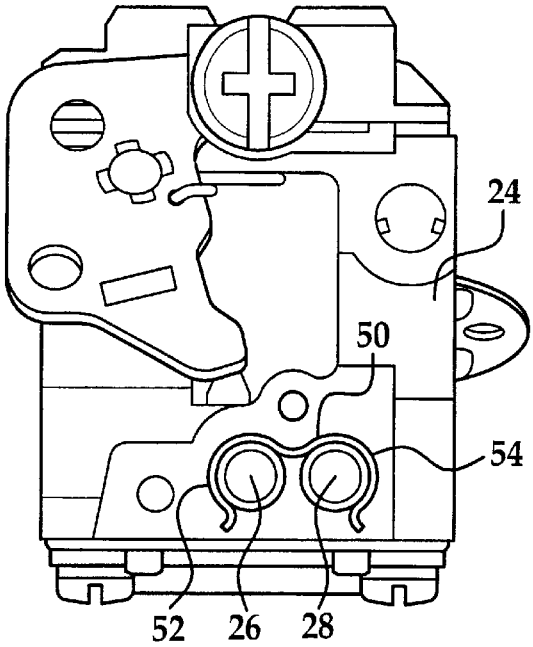
FIG. 3 is a side view of the carburetor.
Figure 4:
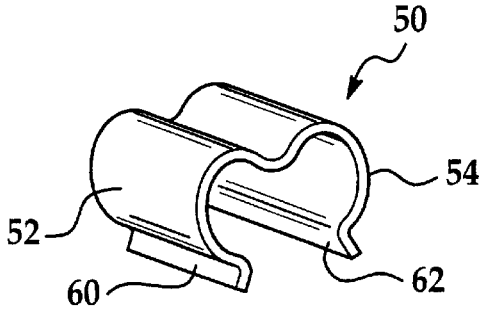
FIG. 4 is a perspective view of a first embodiment of the retainer being a clip retainer.

Referring to FIGS. 2–4, a first embodiment of the retainer 22 is illustrated as a clip retainer 50 which laterally engages both springs 34 of the respective low and high-speed needle valves 26, 28 to laterally bias the projecting portions of the shanks 46 toward one another. An angled first leg 52 of the clip retainer 50 engages the spring 34 and thereby interconnects with a longitudinal outward surface 56 of the shank 46 of the low speed needle valve 26, which faces outward with respect to the high-speed needle valve 28. An angled second leg 54 of the clip retainer 50 engages the other spring 34 and interconnects with a longitudinal outward face 56 of the shank 46 of the high-speed needle valve 28, which faces outward with respect to the shank 46 of the low-speed needle valve 26. The clip retainer 50 laterally snap fits or is interference fitted about both the low and high-speed needle valves 26, 28. To assist in the snap fit, the distal ends 60, 62 of the respective first and second legs 52, 54 bend substantially radially outward with respect to the shank 46 of the respective low and high-speed needle valves 26, 28.

Figure 5:
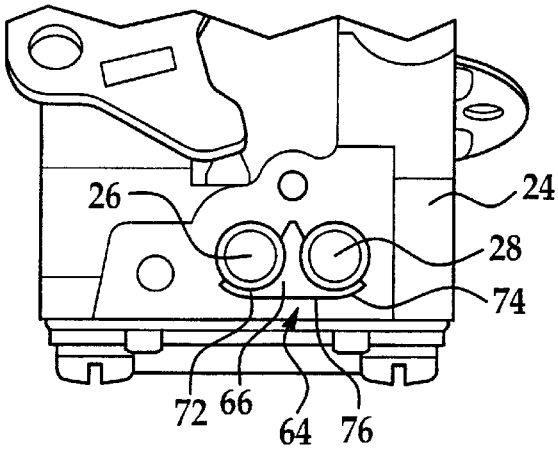
FIG. 5 is a side view of the carburetor illustrating a second embodiment of the retainer being a wedge retainer.
Figure 6:
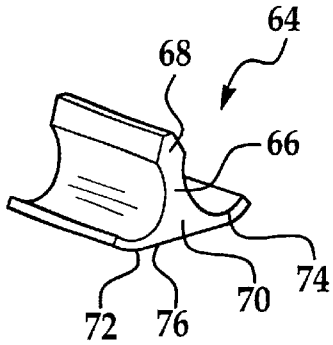
FIG. 6 is a perspective view of the wedge retainer.

Referring to FIGS. 1, 5 and 6, a second embodiment of the retainer 22 is shown as a wedge retainer 64. The wedge retainer 64 may take the form of a variety of shapes including an L-shape, an I-shape and preferably a T-shape. The wedge retainer 64 has a substantially planar primary member 66 which is wedged, via a snap fit, between and thereby engages the springs 34 of the low and high-speed needle valves 26, 28. The wedging effect causes the projecting portions of the shanks 46 to laterally bias outward from one another. Providing the snap fit is an enlarged distal end 68 of the primary member 66. The thickness of the distal end 68 is appreciably larger than the distance between the low and high speed needle valves 26, 28 in the assembled state. The primary member 66 also has an enlarged base end 70 ensuring, when coupled with the enlarged distal end 68, that the wedge retainer 64 has minimal lateral movement and remains wedged between the springs 34 or shanks 46 during end user adjustment rotation of the low or high-speed needle valves 26, 28. The primary member 66 with the enlarged distal and base ends 68, 70 form the I-shape referred to above.

The primary member 66 of the wedge retainer 64 engages the springs 34 on one side between the distal and base ends 68, 70 and thereby interconnects with a longitudinal inward face 71 of the shank 46 of the low-speed needle valve 26 which radially faces generally toward the shank 46 of the high-speed needle valve 28. Likewise, the primary member 66 engages the other spring 34 on the other side and thereby interconnects with the longitudinal inward surface 71 of the shank 46 of the high speed needle valve 28 which faces substantially toward the shank 46 of the low-speed needle valve 26.

The wedge retainer 64 has a substantially planar first base member 72 extending substantially perpendicularly from the primary member 66 along the base end 70. Base member 72 is disposed generally tangentially with respect to the shank 46 of the low-speed needle valve 26. The primary member 66 coupled with the first base member 72 form the L-shape referred to above. Preferably, the wedge retainer 64 also has a substantially planar second base member 74 extending from the primary member 66 along the base end 70, but in an opposite direction with respect to the first base member 72. The second base member 74 lies generally tangentially to the shank 46 of the high-speed needle valve 28. The first and second base members 72, 74 lie substantially within the same imaginary plane and thereby compose an enlarged surface 76 upon which a force can be exerted to snap fit the wedge retainer 64 between the low- and high-speed needle valves 26, 28. The primary, first base and second base members 64, 72, 74 form the T-shape referred to above.

Figure 7:
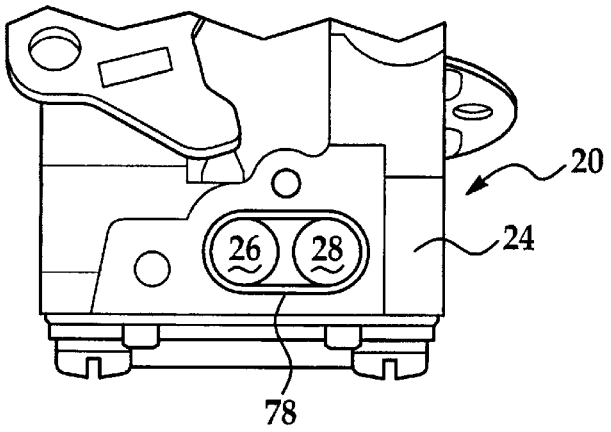
FIG. 7 is a partial side view of the carburetor illustrating a third embodiment of the retainer being a band retainer.
Figure 8:
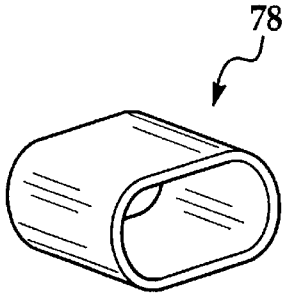
FIG. 8 is a perspective view of the band retainer.

Referring to FIGS. 1, 7 and 8, a third embodiment of the present invention is shown wherein the retainer 22 is a band retainer 78. Like the clip retainer 50, the band retainer 78 laterally bands or biases together the projecting portions of the shanks 46 of the respective low and high-speed needle valves 26, 28. The band retainer 78 encircles both the shanks 46 of the low and high-speed needle valves 26, 28 and may be made of an elastic or plastic material which may also have a shrinking capability upon the application of heat.

Figure 9:
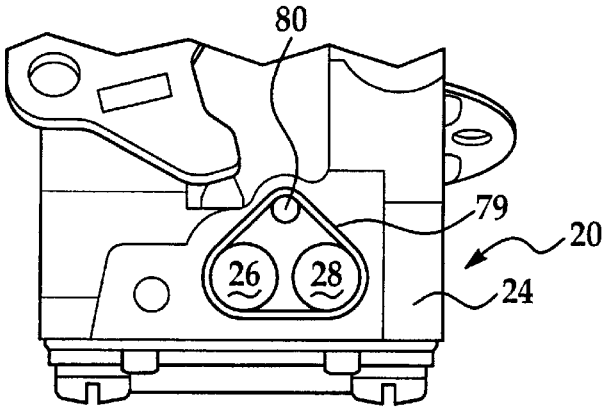
FIG. 9 is a partial side view of the carburetor illustrating a fourth embodiment of the retainer being a triangular band retainer having a pin.
Figure 10:
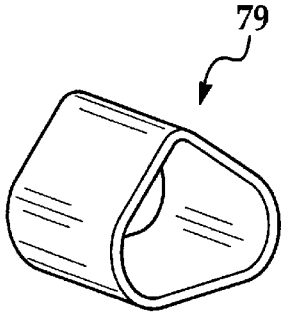
FIG. 10 is a perspective view of the triangular band retainer.

Referring to FIGS. 1, 9 and 10 a fourth embodiment of the retainer 22 is shown as being a triangular band retainer 79 having a slightly larger diameter or circumference than the band retainer 78. The larger diameter enables the band retainer 79 to encircle not only the shanks 46 but also a pin 80 which rigidly protrudes outward from the carburetor body 24. The pin 80 is preferably and substantially disposed at an equal distance from the low and high-speed needle valves 26, 28. As with band retainer 78 above, the triangular band retainer 79 can be made of the same material as the band retainer 78.

Figure 11:
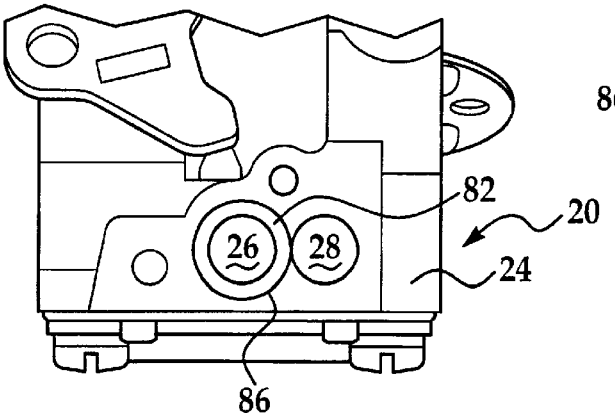
FIG. 11 is a partial side view of the carburetor illustrating a fifth embodiment of the retainer being a ring retainer.
Figure 12:
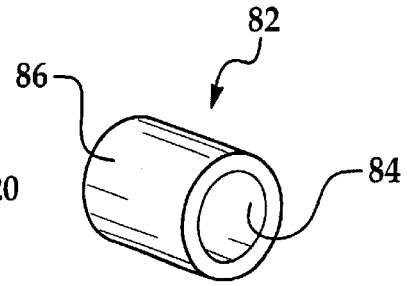
FIG. 12 is a perspective view of the ring retainer.
Figure 13:
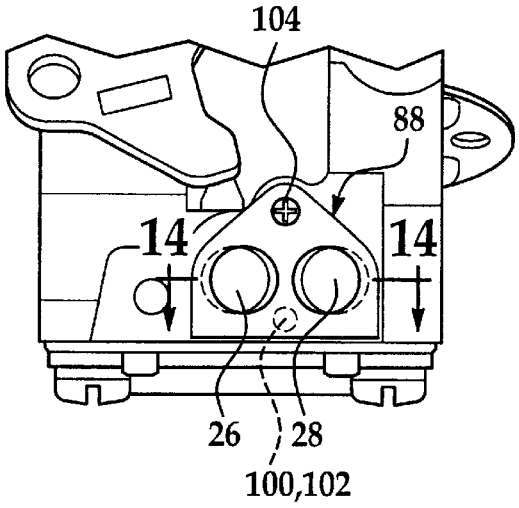
FIG. 13 is a partial side view of the carburetor illustrating a sixth embodiment of the retainer being a block retainer.

Referring to FIGS. 1, 11 and 12, a fifth embodiment of the retainer 22 is shown as being a ring retainer 82 preferably made of a plastic material. The ring retainer 82 biases the projecting portions of the shanks 46 of the low and high-speed needle valves 26, 28 similar to the wedge retainer 64. The ring retainer 82 is concentrically disposed about the spring 34 and the shank 46 of either the low or high-speed needle valves 26, 28. The thickness of the ring retainer 82 wall is slightly larger than the distance between the needle valves 26, 28 and is defined by a circumferential inward surface 84 and a circumferential outward surface 86. Because the radial distance between the inward surface 84 and the outward surface 86 is larger than the distance between the springs 34, the ring retainer 82 laterally biases the projecting portions of the shanks 46 outward or away from one another.

Referring to FIGS. 1, 13–15, a sixth embodiment of the retainer 22 is shown as being a block retainer 88. The block retainer 88 laterally displaces either one of the shanks 46 of the low and high-speed needle valves 26, 28. The block retainer 88 has a continuous curved surface 90 defining an angled bore 91 and extended between an inward perimeter 92 and an outward perimeter 94. The inward perimeter 92 is centered about a centerline 96 of the respective hole 30. The outward perimeter 94 is radially misaligned to the centerline 96 of the hole 30. This mis-alignment forces the low or high-speed needle valves 26, 28 to become laterally displaced. The non-displaced needle valve inserts within a pilot hole 98 (shown in FIG. 15) of the block retainer 88 which is centered about the centerline 96 of the other hole 30.

Figure 14:
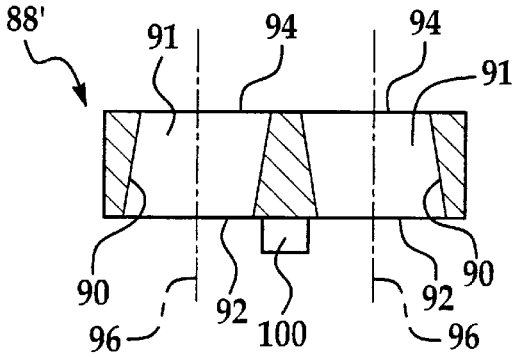
FIG. 14 is a cross section view of the block retainer having two angled bores taken along line 14—14 of FIG. 13.
Figure 15:
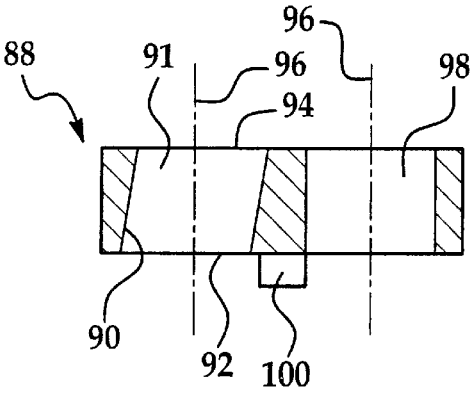
FIG. 15 is the cross section view of the block retainer of FIG. 14 with one of the angled bores replaced with a pilot hole.

Referring to FIG. 14, block retainer 88' is shown wherein lateral displacement of both the low and high-speed needle valves 26, 28 is achieved by replacement of the pilot hole 98 with another angled bore 91. The bores 91 are preferably angled toward or away from one another and are preferably not parallel to one another. The opposing angles will help avoid misalignment of the block retainer 88 to the carburetor body 24 during assembly. Also during assembly, an indexing feature 100 of the block retainer 88 mates with a mating indexing feature 102 (shown in FIG. 16) on the carburetor body 24. Preferably, the indexing feature 100 is an inward extended pin and the mating indexing feature 102 of the carburetor body 24 is an orifice or receptacle.

When the block retainer 88 is utilized with the low and high-speed needle valves 26, 28 a threaded fastener 104 secures the block retainer 88 to the carburetor body 24. Preferably, the threaded fastener is a screw or bolt, counter sunk into the block retainer 88 and threaded into the carburetor body 24.

Figure 16:
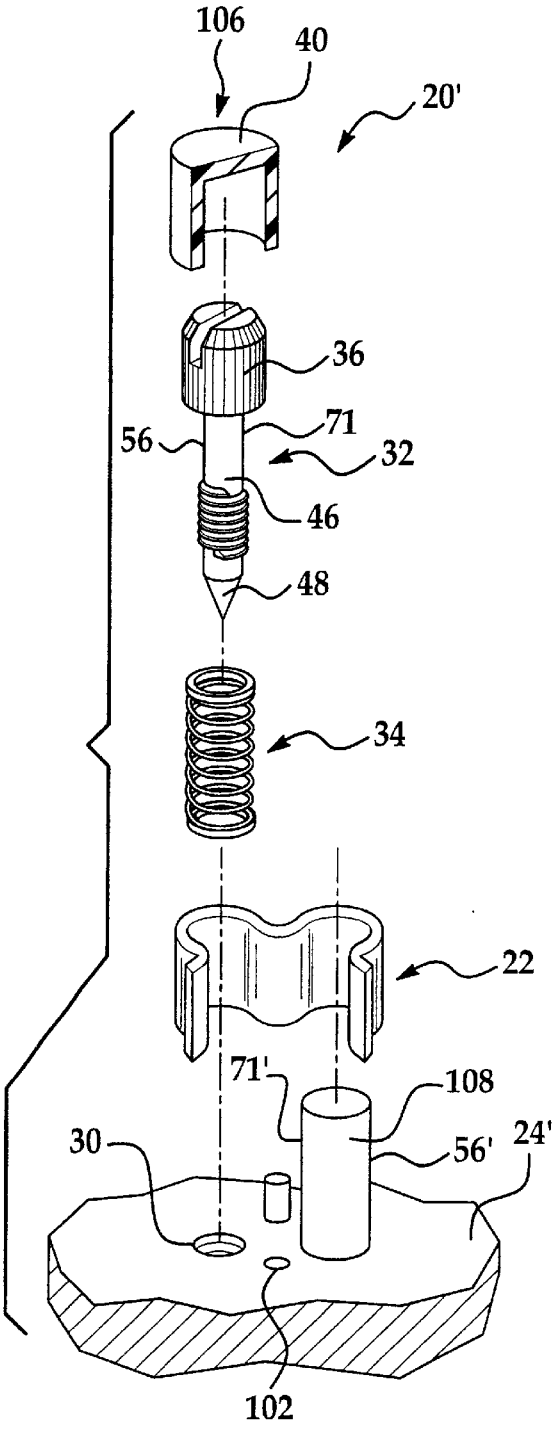
FIG. 16 is an exploded perspective view of a carburetor valve rotational setting retainer assembly illustrating a seventh embodiment having a single fuel needle valve and a pin.

Referring to FIG. 16, yet another embodiment of the retainer assembly 20' is shown wherein either the low or high-speed needle valve 26, 28 is a fuel needle valve 106 and the remaining valve is eliminated and replaced with a dummy needle valve or shaft 108 which projects rigidly outward from the carburetor body 24'. The retainer 22 engages the fuel-air mixture needle valve 106 and the shaft 108 as it does with the low and high-speed needle valves 26, 28 shown in FIG. 1. When utilizing the block retainer 88 embodiment of the retainer 22, the shaft 108 is press fitted into the pilot hole 98. This press fit eliminates the need for the threaded fastener 104. The preferable material for the block retainer 88 is plastic.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention.

We claim:

1. A retaining assembly to maintain yieldingly the rotational setting of a fuel needle valve of a carburetor comprising:

a carburetor body having a passage extending to the exterior thereof, at least a portion of the passage being threaded, a rotatable elongated needle of the fuel needle valve having a threaded portion complimentary to and threadably engaged with the threaded portion of the passage of the carburetor body, the needle having a tip received in the carburetor body and a shank extended outward from the carburetor body, a shaft extended longitudinally outward from the carburetor body, the shaft being parallel to the shank of the fuel needle valve; and a retainer engaged to both the shank and the shaft outward of the carburetor body and laterally biasing the fuel needle valve relative to the carburetor body.

2. The retaining device according to claim 1 further comprising:

the projecting shank biased laterally toward the shaft by the retainer;

the shank and the shaft each having a longitudinal outward surface, the outward surface of the shank facing away from the shaft, the outward surface of the shaft facing away from the shank; and the retainer being a band retainer encircling both the shank and the shaft, the band retainer resiliently engaging the outward surfaces of the shank and shaft.

3. The retaining device according to claim 2 comprising a pin extended outward from the carburetor body and disposed parallel to the shank and shaft, the band retainer being a triangular band retainer also encircling the pin.

4. The retaining device according to claim 3 wherein the band retainer is made of a resiliently stretchable material and thereby stretched prior to being installed from an axially inward direction about the shank and shaft.

5. The retaining device according to claim 3 wherein the band retainer is made of a plastic material and shrunk by the application of heat after the band retainer is installed from an axially inward direction about the shank and shaft.

6. The retaining device according to claim 5 wherein the fuel needle valve is a low speed needle valve and the shaft is the rotatable shank of a high-speed needle valve.

7. The retaining device according to claim 1 further comprising:

the shank being biased laterally away from the shaft by the retainer;

a longitudinal inward surface of the shank of the fuel needle valve facing a longitudinal inward surface of the shaft; and the retainer being a wedge retainer having a primary member extended from an enlarged distal end to an enlarged base end, the primary member disposed between and engaged to the inward surfaces of the shank and shaft thereby biasing the shank laterally away from the shaft.

8. The retaining device according to claim 7 wherein the wedge retainer has a first base member engaged to the base end and disposed perpendicularly to the primary member.

9. The retaining device according to claim 8 wherein the wedge retainer has a second base member engaged to the base end opposite the first base member, the first and second base members lying within the same imaginary plane.

10. The retaining device according to claim 9 wherein the fuel needle valve is a low speed needle valve and the shaft is the rotatable shank of a high-speed needle valve.

11. The retaining device according to claim 1 further comprising:

the retainer being a block retainer laterally displacing the projecting shank of the fuel needle valve, the block retainer engaged laterally to the shank and the shaft;

the block retainer having a pilot hole and a continuous curved surface defining an angled bore, the curved surface extending between an inward perimeter and an outward perimeter, the shank disposed in the angled bore and the shaft disposed in the pilot hole; and the hole of the carburetor body having a centerline, the inward perimeter centered about the centerline, the outward perimeter mis-aligned radially to the centerline.

12. The retaining device according to claim 11 wherein the block retainer is secured to the carburetor body by a threaded fastener.

13. The retaining device according to claim 12 wherein the fuel needle valve is a low speed needle valve and the shaft is the rotatable shank of a high speed needle valve, and wherein the pilot hole of the block retainer is a second angled bore.

14. The retaining device according to claim 13 wherein the block retainer has an indexing feature and the carburetor body has a mating indexing feature for aligning the retainer block to the carburetor body.

15. A retaining assembly to maintain yieldingly the rotational setting of a fuel needle valve of a carburetor comprising:

a rotatable elongated needle of the fuel needle valve engaged threadably to the carburetor, the needle having a shank extended outward from the carburetor;

a shaft extended outward from the carburetor, the shaft being parallel to the shank of the fuel needle valve;

a retainer engaged to and laterally biasing the fuel needle valve and the shaft, the projecting needle valve shank being biased laterally toward the shaft by the retainer;

the shank and the shaft each having a longitudinal outward surface, the outward surface of the shank facing away from the shaft, the outward surface of the shaft facing away from the shank; and the retainer being a clip retainer having a first leg engaged to the outward surface of the shank, a second leg engaged to the outward surface of the shaft, the first leg engaged to the second leg, the clip retainer being snap fitted from a lateral direction about the shank and the shaft.

16. The retaining device according to claim 15 wherein the first and second legs of the clip retainer each have a distal end curving radially outward from the respective shank and shaft.

17. The retaining device according to claim 16 wherein the fuel needle valve is a low-speed needle valve and the shaft is the rotatable shank of a high-speed needle valve engaged threadably to the carburetor and laterally biased by the retainer.

* * * * *